US005340031A

United States Patent [19]

Neuhaus et al.

[11] Patent Number: 5,340,031

[45] Date of Patent: Aug. 23, 1994

[54] FOAMING HEAD

[75] Inventors: Reinhard Neuhaus, Hemer; Jens-Heinrich Kersten, Kamen-Heeren; Detlef Schmitz, Lunen, all of Fed. Rep. of Germany

[73] Assignee: Perfect-Valois Ventil GmbH, Dortmund-Wickede, Fed. Rep. of Germany

[21] Appl. No.: 98,456

[22] Filed: Jul. 27, 1993

[30] Foreign Application Priority Data

Jul. 28, 1992 [DE] Fed. Rep. of Germany ..... 4224910

[51] Int. Cl.[5] ..... B05B 1/14

[52] U.S. Cl. ..... 239/343; 239/520; 239/524; 239/590.5; 222/402.21

[58] Field of Search ..... 239/343, 600, 520, 521, 239/524, 499, 500, 590.5, 337, 522; 222/402.21, 153

[56] References Cited

U.S. PATENT DOCUMENTS

| | | | |
|---|---|---|---|
| 2,945,629 | 7/1960 | Chute et al. | 239/590.5 |
| 3,333,744 | 8/1967 | Nilsen et al. | 222/402.13 |
| 3,933,283 | 1/1976 | Hoagland | 222/402.21 |
| 4,055,302 | 10/1977 | Hruby, Jr. | 239/590.5 |
| 4,239,407 | 12/1980 | Knight | 401/190 |
| 4,720,046 | 1/1988 | Morane | 239/343 |
| 4,901,891 | 2/1990 | Goncalves | 222/402.21 |
| 5,139,201 | 8/1992 | De Laforcade | 239/343 |
| 5,255,851 | 10/1993 | Tobler | 239/590.5 |
| 5,263,616 | 11/1993 | Abplanalp | 222/402.21 |

FOREIGN PATENT DOCUMENTS

| | | | |
|---|---|---|---|
| 452208A1 | 10/1991 | European Pat. Off. | B65D 83/14 |
| 3644237A1 | 6/1987 | Fed. Rep. of Germany | B65D 83/14 |
| 8515097 | 4/1987 | France | B05D 1/00 |

*Primary Examiner*—Andres Kashnikow
*Assistant Examiner*—Christopher G. Trainor
*Attorney, Agent, or Firm*—Dressler, Goldsmith, Shore & Milnamow, Ltd.

[57] ABSTRACT

A foaming head (10) has a discharge nozzle (12), the discharge channel (14) of which has at the upper end a tubular section (16), the upper end of which is closed by a deflecting plate (18) and is provided with passage slits (22) which open out radially into an outlet slit (24) in the head wall (20). An inner base (26) of each outlet slit (24) extends radially outwardly from the lower end (28) of each passage slit (22) as far as a deflecting wall (30) which together with the discharge channel (14) forms an acute angle which opens towards the head wall (20). An upper end (32) of each deflecting wall (30) is arranged at a level which is approximately two-thirds of the height of the tubular section (16). An outer base (34) of each outlet slit (24) extends radially outwardly from the upper end (32) of the deflecting wall (30) as far as the vicinity of an outer edge (36) of the head wall (20). The foaming head can be produced economically as a one-part plastics injection molding and, with an extremely simple construction, permits outstanding foaming of a foamable product contained in a pressure container.

11 Claims, 2 Drawing Sheets

Figure 4:
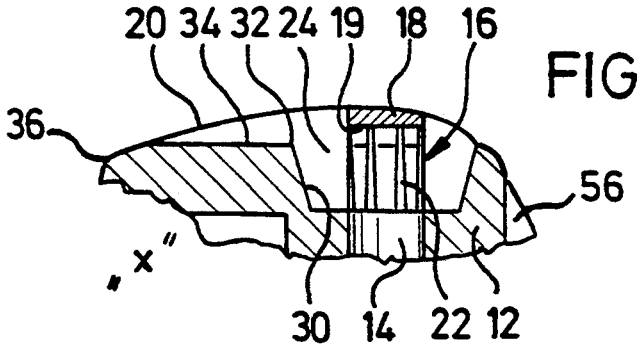

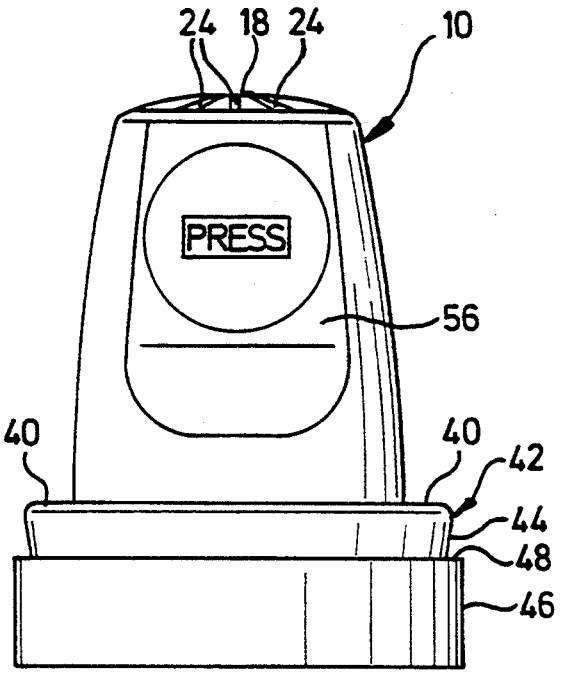
FIG. 1
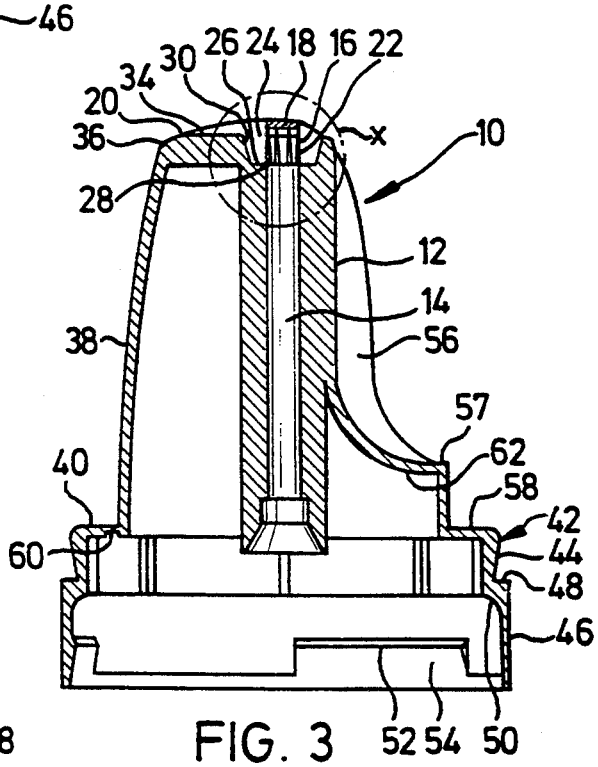
FIG. 3
FIG. 2
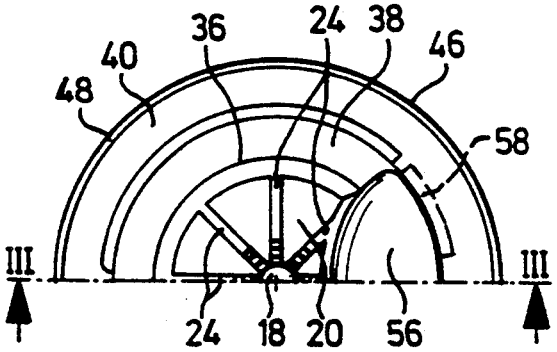

FOAMING HEAD

The invention relates to a foaming head for a manually operated pressure container having a discharge valve, onto the tubular valve shank of which the foaming head with a tubular discharge nozzle can be pushed for operating the discharge valve, a discharge channel extending through the discharge nozzle and being connected to a plurality of discharge openings of the foaming head which are connected to the inner cheer of the pressure container when the discharge valve is open.

A foaming head of this generic type is disclosed in EP 452 208 A1. This foaming head is of multi-part, complicated construction, so that it is relatively complex for disposable pressure containers.

DE 36 44 237 A1 also discloses a foaming head which is of multi-part design. In this case an attachment is provided which can be mounted on a nozzle of a discharge head. The attachment contains a deflecting plate in a widening opening in the attachment. A mesh is attached on the outlet opening of the attachment with the aid of a locking ring. In addition to the complex design consisting of a plurality of parts, the attachment, which projects freely from the discharge head, is relatively impact-sensitive.

Furthermore, French Patent Application 2 588 490 discloses a foaming head which, although it can be produced as a one-part injection molding of plastic, can only be utilized in conjunction with a discharge head mounted on a discharge valve of a pressure container. As a result, this arrangement is also relatively complex both from the point of view of assembly and in terms of production technology.

The invention is based on the object of improving a foaming head of the known generic type mentioned at the outset in such a manner that it can be produced economically for disposable pressure containers and, with an extremely simple construction, permits outstanding foaming of a foamable product contained in a pressure container.

To achieve this object, the invention is characterized in that a) the discharge channel is designed at its upper end as a thin-walled tubular section,
b) the tubular section is closed at its upper end by a deflecting plate which forms part of a head wall of the foaming head and the diameter of which corresponds to that of the tubular section,
c) the tubular section is provided around its circumference with passage slits which are parallel to the discharge channel and are separated from one another by an angle at the circumference and in each case open out radially into an outlet slit in the head wall,
d) an inner base of each outlet slit extends radially outwardly from the lower end of the associated passage slit as far as the base of a deflecting wall which together with the discharge channel forms an acute angle which opens towards the head wall,
e) an upper end of each deflecting wall is arranged at a level which is approximately two-thirds of the height of the tubular section,
f) an outer base of each outlet slit extends radially outwardly from the upper end of the deflecting wall as far as the vicinity of an outer edge of the head wall.

Especially good foaming can be obtained if the underside of the deflecting plate which faces the discharge channel projects into the discharge channel in the form of a cone. Furthermore, it is advisable to dimension both the passage slits and the outlet slits in each case independently to be of equal width.

Furthermore the discharge nozzle can be surrounded by a conical upper part which extends from the outer edge of the head wall as far as a lower outer annular shoulder from which a casing projects downwardly, which casing has an upper part and a lower part which corresponds approximately to an inner shoulder with which the foaming head can be supported on the edge of a container lid. It is expedient to provide the lower part of the casing with locking strips which are arranged at a distance below the inner shoulder around the circumference of an inner wall of the lower casing part in such a manner that the locking strips can engage below the edge of the container lid in a locking manner so as to fasten the foaming head.

The conical upper part is expediently provided on one side with a finger dent which extends approximately over the entire height of the upper part and intersects the head wall radially outside the deflecting wall. In this case it is advisable also to connect the conical upper part at the side having the finger dent to the outer shoulder of the casing by means of an articulated rib and, at the opposite side, to the outer shoulder by means of at least one predetermined breaking web. By this means it is possible to produce the foaming head together with the casing provided for fastening to a pressure container in one part. The articulated rib on one side of the finger dent permits operation of the discharge valve fastened in a pressure container by exertion of a lateral finger pressure on the foaming head, which in this manner can be moved around the articulated rib towards the discharge valve in order to operate the latter. The at least one predetermined breaking point opposite the articulated rib is destroyed by this and makes the putting into operation of the pressure container recognizable.

Preferably the finger dent is disposed at a distance above the outer shoulder and extends over approximately 90° of the circumference of the conical upper part.

Furthermore, it is expedient to connect a reverse side of the finger dent to the discharge nozzle over the upper two-thirds of its height. By this means a high stability of the foaming head is achieved with low material use.

Advantageously, the head wall is bulged upwardly and outwardly and is provided with eight outlet slits which extend radially outwardly in a stellate manner from the central deflecting plate of the head wall and are open towards the upperside of the head wall. By this design, the foaming head not only receives an attractive appearance but it also allows foam discharge without, with the operation of the pressure container by exerting a finger pressure onto the finger dent transversely to the longitudinal axis of the foaming head, for getting onto the operating hand of the person operating the pressure container.

A particular advantage of the invention consists in the fact that the foaming head consists of a one-part plastics injection molding.

Figure 5:
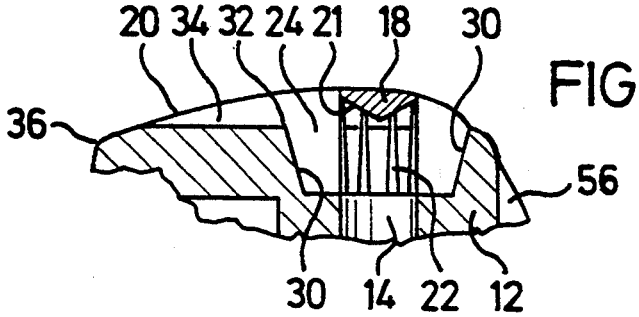
Figure 6:
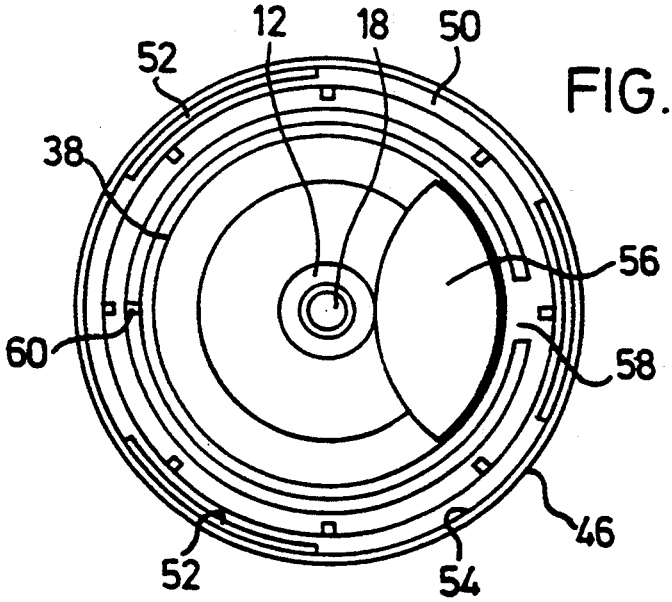

The invention is described in greater detail below with the aid of the diagrammatic drawing, in which: FIG. 1 shows a side view of a foaming head with a lateral finger dent; FIG. 2 shows a plan view of one symmetrical half of the foaming head in FIG. 1; FIG. 3 shows a central longitudinal section through the plane of symmetry III—III in FIG. 2; FIG. 4 shows the section X in FIG. 3 on an enlarged scale; FIG. 5 shows a variant of the view in FIG. 4; and FIG. 6 shows a bottom view of the foaming head in FIG. 1.

The figures show a foaming head 10 which is made in one part from plastic by injecting molding for a manually operated pressure container which is known per se and therefore not shown and is provided with a discharge valve, onto the tubular valve shank of which the foaming head 10 with a tubular discharge nozzle 12 can be pushed for operating the discharge valve. A discharge channel 14 extends through the discharge nozzle 12 and is connected to a plurality of discharge openings of the foaming head 10 which are connected to the inner chamber of the pressure container when the discharge valve is open.

According to FIG. 3 and 4, the discharge channel 14 is designed at its upper end as a thin-walled tubular section 16. The tubular section 16 is closed at its upper end by a deflecting plate 18. The deflecting plate 18 forms part of an outwardly and upwardly bulged head wall 20 of the foaming head 10. The deflecting plate has a diameter which corresponds to that of the tubular section 16. An underside 19, facing the discharge channel 14, of the deflecting plate 18 is designed with a flat surface and extends perpendicularly to the longitudinal axis of the vertically aligned discharge nozzle 12 or of the discharge channel 14.

FIG. 5 shows the underside of the deflecting plate 18 as a circular cone 21 which preferably tapers to a point and projects coaxially into the discharge channel 14.

The tubular section 16 is provided around its circumference with eight passage slits 22 which extend parallel to the discharge channel 14 and are separated from one another by an angle at the circumference. The passage slits 22 open out in each case radially into an outlet slit 24 in the head wall 20. It is apparent that both the eight passage slits 22 and the eight outlet slits 24 have in each case independently equal dimensions. The passage slits 22 and the outlet slits 24 are also in each case dimensioned to be of equal width. This achieves a uniform foaming of the product through each of the passage slits 22 and the outlet slits 24.

An inner base 26 of each outlet slit 24 extends radially outwardly from the lower end 28 of the associated passage slit 22 as far as the base of a deflecting wall 30. The deflecting wall 30 forms together with the discharge channel 14 an acute angle which opens towards the head wall 20. An upper end 32 of each deflecting wall 30 is arranged at a level which is approximately two-thirds of the height of the tubular section 16.

The product to be foamed is deflected by the deflecting plate 18 against the deflecting wall 30 and there foams again. The cone 21 improves the deflection of the product against the deflecting wall 30 by a more favorable deflection angle. The conical angle of the circular cone 21 is preferably chosen sufficiently obtuse for all streamlines of the product deflected by the conical envelope surface to be directed towards the deflecting wall 30 in each outlet slit 24, so that the product is again completely foamed at the deflecting wall 30.

An outer base 34 of each outlet slit 24 extends radially outwardly from the upper end 32 of the deflecting wall 30 of each outlet slit 24 as far as the vicinity of an outer edge 36 of the head wall 20.

The discharge nozzle 12 is surrounded by a conical upper part 38. This conical upper part 38 extends from the outer edge 36 of the head wall 20 as far as a lower outer annular shoulder 40. A casing 42 projects downwardly from the outer annular shoulder 40. The casing 42 consists of an upper part 44 and a lower part 46. The upper part 44 and the lower part 46 are connected by an outer shoulder 48. This outer shoulder 48 corresponds approximately to an inner shoulder 50 with which the foaming head 10 can be supported on the edge of a container lid.

The lower part 46 of the casing 42 is additionally provided with locking strips 52 which are arranged at a distance below an inner shoulder 50 around the circumference of an inner wall 54 of the lower casing part 46. In this manner the locking strips 52 can engage below the edge of the container lid in a locking manner so as to fasten the foaming head 10.

The conical upper part 38 of the foaming head 10 is provided on one side with a finger dent 56. This finger dent 56 extends approximately over the entire height of the upper part 38 and intersects the head wall 20 radially outside the deflecting wall 30 in an arcuate manner, as shown in FIG. 6. As a result, a uniform foaming of the product through all outlet slits is ensured.

The conical upper part 38 is connected at the side having the finger dent 56 to the outer shoulder 48 of the casing 42 by means of a film hinge 58. Since this film hinge 58 is provided only on one angle at the circumference, which is smaller than 90°, the conical upper part 38 can be operated with respect to the casing 42, about the film hinge 58, in the sense of operating the discharge valve by pressing down its tubular valve shank. On the side opposite the film hinge 58, the conical upper part 38 is connected to the annular shoulder 40 by means of at least one predetermined breaking web 60. This predetermined breaking web 60 can be designed to be of such a strength that it forms a childproof seal, that is to say can only be destroyed by adults. Moreover, a destroyed predetermined breaking web indicates the putting into operation of the pressure package.

The finger dent 56 is disposed at a distance above the annular shoulder 40 at 57 and extends over approximately 90° of the circumference of the conical upper part 38. A reverse side 62 of the finger dent 56 is connected to the discharge nozzle 12 over the upper two-thirds of the height of the discharge nozzle 12. By means of the concave shape of the finger dent 56 and the connection to the discharge nozzle 12, the foaming head 10 obtains a high strength which permits, on the other hand, a saving of the material necessary for producing the foaming head.

As can be seen from the figures, the head wall 20 of the foaming head 10 is bulged upwardly and outwardly and has eight outlet slits 24 which extend radially outwardly in a stellate manner from the central deflecting plate 18 of the head wall and are open towards the upper side of the head wall 20. By this means the foaming head 10, as shown in particular by FIG. 1, obtains an attractive appearance and permits operation for foam discharge in which the finger operating the foaming head 10 remains unwetted by the discharged foam.

The foaming head 10 can be produced economically as a one-part plastics injection molding, for example from polypropylene, and is therefore highly suitable for disposable pressure packages with products to be foamed.

We claim:

1. A foaming head (10) for a manually operated pressure container having a discharge valve including a tubular discharge nozzle (12) adapted to operate the discharge valve, a discharge channel (14) extending through the discharge nozzle (12) and being connected to a plurality of discharge openings defined by the foaming head and adapted to be connected to the pressure container when the discharge valve is open, wherein a) the discharge channel (14) is designed at its upper end as a thin-walled tubular section (16), b) the tubular section (16) is closed at its upper end by a deflecting plate (18) which forms part of a head wall (20) of the foaming head (10) and having a diameter which corresponds to that of the tubular section (16), c) the tubular section (16) is provided around its circumference with passage slits (22) which are parallel to the discharge channel (14) and are separated from one another by an angle at said circumference and in each case opens out radially into an outlet slit (24) in the head wall (20), which slits form a portion of said discharge openings, d) an inner base (26) of each of said outlet slits (24) extends radially outwardly from the lower end (28) of the associated passage slit (22) as far as the base of a deflecting wall (30) which together with the discharge channel (14) forms an acute angle which opens towards the head wall (20), e) an upper end (32) of said deflecting wall (30) is arranged at a level which is approximately two-thirds of the height of the tubular section (16), f) an outer base (34) of each outlet slit (24) extends radially outwardly from the upper end (32) of the deflecting wall (30) as far as the vicinity of an outer edge (36) of the head wall (20).

2. The foaming head as claimed in claim 1, wherein the underside of the deflecting plate (18) which faces the discharge channel (14) projects into the discharge channel (14) in the form of a cone (21).

3. The foaming head as claimed in claims 1 or 2, wherein the passage slits (22) and the outlet slits (24) are dimensioned to be of equal width.

4. The foaming head as claimed in one of claims 1 or 2, wherein the discharge nozzle (12) is surrounded by a conical upper part (38) which extends from the outer edge (36) of the head wall (20) as far as a lower, outer annular shoulder (40) from which a casing (42) projects downwardly, which casing has an upper part (44) and a lower part (46) which are connected by an outer shoulder (48) which corresponds approximately to an inner shoulder (50) with which the foaming head (10) can be supported.

5. The foaming head as claimed in claim 4, wherein the lower part (46) of the casing (42) is provided with locking strips (52) which are arranged at a distance below the inner shoulder (50) around the circumference of an inner wall (54) of the lower casing part (46) in such a manner that the locking strips (52) can fasten the foaming head (10) in position.

6. The foaming head as claimed in claim 5, wherein the conical upper part (38) is provided on one side with a finger dent (56) which extends approximately over the entire height of the upper part (38) and intersects the head wall (20) radially outside the deflecting wall (30).

7. The foaming head as claimed in claim 6, wherein the conical upper part (38) is connected at the side having the finger dent (56) to the outer shoulder (48) of the casing (42) by means of a film hinge (58) and, at the opposite side, to the outer shoulder (48) by means of at least one predetermined breaking web (60).

8. The foaming head as claimed in claim 6, wherein the finger dent (56) is disposed at a distance above the outer shoulder (48) and extends over approximately 90° of the circumference of the conical upper part (38).

9. The foaming head as claimed in claim 6, wherein a reverse side (62) of the finger dent (56) is connected to the discharge nozzle (12) over the upper two-thirds of the height of the discharge nozzle (12).

10. The foaming head as claimed in one of claims 1 or 2, wherein the head wall (20) is bulged upwardly and outwardly and has eight of said outlet slits (24) which extend radially outwardly in a stellate manner from the deflecting plate (18) of the head wall (20) and are open towards the upper side of the head wall (20).

11. The foaming head as claimed in one of claims 1 or 2, wherein it is a one-part plastics injection molding.

* * * * *